US008813388B2

(12) United States Patent
Gismondi

(10) Patent No.: US 8,813,388 B2
(45) Date of Patent: Aug. 26, 2014

(54) OPERATING PROCESS FOR THE PRODUCTION OF AN INSOLE FOR FOOTWEAR AND INSOLE THUS OBTAINED

(75) Inventor: Andrea Gismondi, Corridonia (IT)

(73) Assignee: Novarese S.r.l. (IT)

( * ) Notice: Subject to any disclaimer, the term of this patent is extended or adjusted under 35 U.S.C. 154(b) by 459 days.

(21) Appl. No.: 13/376,375

(22) PCT Filed: Jul. 21, 2010

(86) PCT No.: PCT/IT2010/000321

§ 371 (c)(1),
(2), (4) Date: Dec. 28, 2011

(87) PCT Pub. No.: WO2011/010336

PCT Pub. Date: Jan. 27, 2011

(65) Prior Publication Data

US 2012/0151797 A1 Jun. 21, 2012

(30) Foreign Application Priority Data

Jul. 23, 2009 (IT) ..... MC2009A0172

(51) Int. Cl.

| | |
|---|---|
| ***A43B 3/00*** | (2006.01) |
| ***A43B 15/00*** | (2006.01) |
| ***A43B 9/06*** | (2006.01) |
| ***A43B 13/39*** | (2006.01) |
| ***A43D 8/34*** | (2006.01) |

(52) U.S. Cl.

CPC ..... *A43B 13/39* (2013.01); *A43B 15/00* (2013.01); *A43B 9/06* (2013.01); *A43D 8/34* (2013.01)

USPC ..... 36/22 A; 36/22 R; 36/17 R

(58) Field of Classification Search

CPC ..... A43B 13/38; A43B 13/39; A43B 13/40; A43B 9/04; A43B 9/06

USPC ..... 36/22 A, 22 R, 17 R, 43, 44, 71; 12/142 N, 142 R, 146 M

See application file for complete search history.

(56) References Cited

U.S. PATENT DOCUMENTS

| | | | | |
|---|---|---|---|---|
| 1,393,730 | A * | 10/1921 | Teehan | 36/169 |
| 1,420,461 | A * | 6/1922 | Teehan | 36/169 |
| 1,640,633 | A * | 8/1927 | Wilke, Sr. | 36/91 |
| 2,069,941 | A | 2/1937 | Cantelmo | |

(Continued)

FOREIGN PATENT DOCUMENTS

| | | |
|---|---|---|
| DE | 835569 | 4/1952 |
| GB | 527021 | 10/1940 |
| GB | 1139213 | 1/1969 |

OTHER PUBLICATIONS

PCT International Search Report issued for PCT/IT2010/000321 filed Jul. 21, 2010 in the name of Novarese S.R.L.

*Primary Examiner* — Jila M Mohandesi

(74) *Attorney, Agent, or Firm* — Steinfl & Bruno LLP

(57) ABSTRACT

Machining process for the manufacture of an insole for footwear, having a tape at the bottom face of the insole and around the entire periphery thereof, except only for that horseshoe arch that surrounds the heel of the shoe if desired, the outer edge of said tape being attached to and aligned with the edge Ia) of the insole so that the inner edge of said tape is free to be folded and detached from the bottom face of the insole. An insole for footwear is also described.

11 Claims, 2 Drawing Sheets

(56) References Cited

U.S. PATENT DOCUMENTS 2,146,814 A * 2/1939 Fredericksen ..... 12/146 BP
2,424,428 A * 7/1947 Ayers ..... 36/22 A
2,730,819 A 1/1956 Foust
2,774,699 A * 12/1956 Clark ..... 428/136

* cited by examiner

OPERATING PROCESS FOR THE PRODUCTION OF AN INSOLE FOR FOOTWEAR AND INSOLE THUS OBTAINED

CROSS REFERENCE TO RELATED APPLICATIONS

The present application is the US national stage of International Application PCT/IT2010/000321 filed on Jul. 21, 2010, which in turn, claims priority to Italian Patent Application No. MC2009A000172 filed on Jul. 23, 2009.

This patent application for industrial invention relates to a machining process for making an insole for footwear, especially designed to be used inside an article of footwear obtained using a machining method referred to as "GOOD YEAR".

It is understood that the patent protection extends also to the new insole obtained using the new machining process according to the invention.

In the manufacture of a so-called "pre-assembled" article of footwear, according to a particular known and established technology called "GOOD YEAR", the upper, before being coupled to its sole, is "pre-assembled" on an insole with the aid of a last.

More specifically, according to said technology, firstly the upper, i.e. that part of the shoe designed to enclose the foot at the sides and over the top, is prepared; such an upper is open at the bottom, i.e. around the entire periphery of the sole of the foot, since it is designed to be mounted on said insole, beneath which the true outsole is finally applied.

As previously stated, this operation of "pre-assembling" the upper on the insole is performed with the aid of a "last" practically consisting in a template that reproduces the three-dimensional shape of a foot, onto which is fitted the upper, the bottom flaps of which are then stretched, tucked under and fixed beneath the edges of said insole, previously centred and held in the centre of the sole of said "last". Finally, the sole is glued and sewn beneath said insole.

According to the "GOOD YEAR" machining technique, the sole is wider than the overlying insole, so that the edge of the sole protrudes a few millimeters beyond the upper around its entire periphery, with the exception of the horseshoe arch that surrounds the heel of the shoe.

Fixed along this protruding edge of the sole is a finishing welt, which externally encloses the bottom flap of the upper, covering any machining artefacts along that entire peripheral band of the upper which is folded back and locked between the sole and the insole. In practice, said welt consists in a flexible strip of hide which is folded in an "L" shape, so that its vertical arm can be adhered and sewn to the outside of the bottom flaps of the upper, while its horizontal arm can be adhered and sewn just over the above-mentioned protruding edge of the sole.

Therefore, two rows of stitching run along the welt, one comprising stitches that pass through the upper from the outside inwards and which serve to fix the welt to the upper, the other comprising top-to-bottom stitches that serve to fix the welt to the underlying sole.

In the "GOOD YEAR" machining technique, it is to be said that the stitching that fixes the welt to the outside of the bottom flaps of the upper also serves to fix the upper beneath said insole, which is purposely arranged to provide an effective gripping area for the stitches of said stitching.

According to the older and more traditional technique, fixed beneath the edge of the insole is a flexible strip, usually of cardboard, having a "T" cross-section, the top arm of which is glued at the bottom to the insole, while its vertical arm constitutes that gripping area for the stitches of the above-mentioned stitching passing from the outside towards the inside through the inner edge of the welt, the bottom flaps of the upper and the vertical arm of said strip substantially bringing about the simultaneous fixing of the welt to the upper and to the insole.

Gluing of said flexible strip beneath the insole is usually achieved by means of a thermoplastic adhesive, which must be applied hot and which, once cooled, confers a certain rigidity to said strip which is already semi-rigid due to the fact that its vertical arm incorporates a stiffening core.

This all means that the flexibility of the insole is appreciably compromised by the presence of said strip applied around the entire bottom edge of said insole.

According to an alternative machining technique, a groove is made beneath the edge of the insole, which groove allows one flap of said edge to be insulated and folded downwards, against which the flaps of the upper and the inner edge of the welt are fixed by means of the usual single row of stitching.

Footwear obtained using the "GOOD YEAR" machining technique is characterised by its strength and reliability, as well as by its waterproofness, since the upper is protected at the bottom by a thick multi-layer base formed by the insole and the underlying sole, while laterally it is enclosed by said shielding welt which prevents water from entering between the sole and the insole.

On the other hand, however, footwear obtained using the "GOOD YEAR" machining technique is penalised by poor comfort due to its heaviness and rigidity, which does not allow it to bend softly in order to conform to the natural articulation of the foot during walking. Such a rigidity is basically due to the presence of said "pre-assembly" insole, the thickness of which, varying between three to five millimeters, is added to that of the sole resulting in a thick multi-layer base, which is further stiffened by the layer of adhesive used to glue the sole to the insole before proceeding to the operation of finally sewing the welt to the sole.

On the other hand, said insole is also rigid by itself and somewhat inflexible, both due to said T-section strip whose inherent rigidity is increased by the rigid bead of thermoplastic glue and, in the version where the insole has a peripheral groove, due to the thickness of the hide which must be at least five millimeters to withstand being cut into without the risk of tearing and ripping.

It is precisely the critical observation of this type of footwear that gave rise to the industrial process according to the invention, the main purpose of which is to design a new insole for footwear manufactured using the "GOOD YEAR" method, so as to obtain an article of footwear that is much lighter and more flexible and comfortable, while retaining the above-described properties of sturdiness and waterproofness which are typical of the conventional "GOOD YEAR" machining technique.

From this perspective the new industrial process according to the invention was devised, the main feature of which is to have eliminated both the use of a conventional T-section strip to be glued beneath the edge of the insole, and the adoption of a groove made beneath the edge of the insole, introducing instead the use of a thin tape of hide sewn beneath the edge of the insole, made with a thin soft sheet of hide or soft tanned leather.

This means that between the sole of the wearer's foot and the sole of the shoe there is only a thin soft sheet of hide having a thickness, rigidity and weight of considerably less than the hide insole of three to five millimeters thick which is normally used in the prior art.

It must also be said that the above-mentioned tape of thin hide has a thickness, rigidity and weight that are considerably less than those of the above-mentioned T-section strip, and also the increased rigidity of the insole due to the stitching used to fix said strip of thin hide beneath the edge of the insole is greatly much less than that resulting from the bead of thermoplastic adhesive used to fix the above-mentioned T-section strip.

Another aim of the invention is greatly to increase the comfort of a "pre-assembled" shoe made using the "GOOD YEAR" method, by providing a padded insole so as also to provide the sole of the foot with a supporting surface that is soft as well as flexible.

For further clarity, a description of the process according to the invention now follows with reference to the accompanying drawings, given purely by way of a non-limiting example, in which the various components of the insole are illustrated, before being assembled, during the various steps of assembly and on completion of assembly.

With reference to FIGS. 1 to 5, the process according to the invention first involves the preparation of a novel insole 1, characterised by its light weight, softness and high flexibility.

Preferably, said insole 1 is made of a thin sheet of hide or soft thin tanned leather, or even fabric or cloth. Said insole 1 is provided with an upper face A and an under face B. Sewn onto the under face B of the insole 1 around the entire periphery thereof, with the exception of the horseshoe arch that surrounds the heel of the shoe, is a tape 2 also made of a sheet of hide or soft tanned leather.

More specifically, said tape 2 is fixed to the overlying insole 1 by at least one peripheral stitching C1 running close to the outer edge 2*a* of said tape 2, after having arranged said outer edge 2*a* flush with the edge 1*a* of the insole 1 so that the inner edge 2*b* of said tape 2 is free to be folded and detached from the bottom face B of the insole 1.

Figure 1:
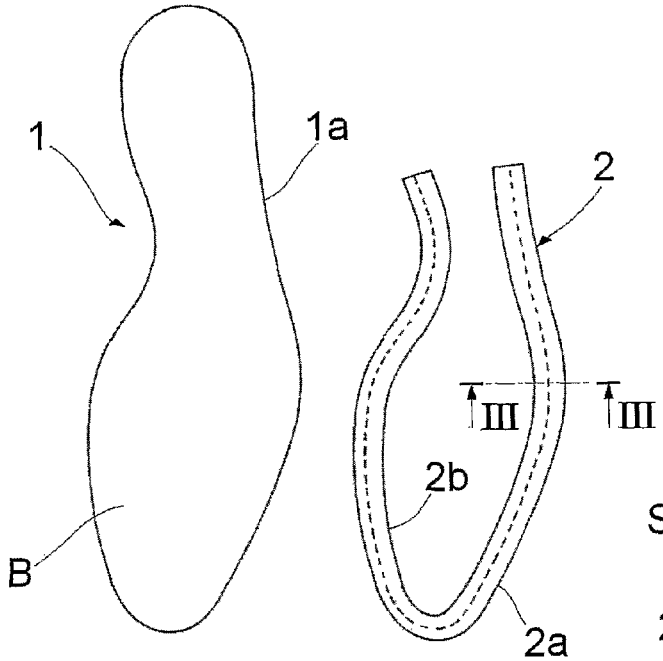
FIG. 1 shows the two basic components of the insole according to the invention before being assembled.
Figure 3:
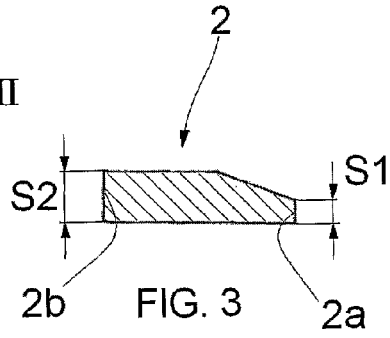
FIG. 3 is a cross-section of FIG. 1 along III-III.
Figure 2:
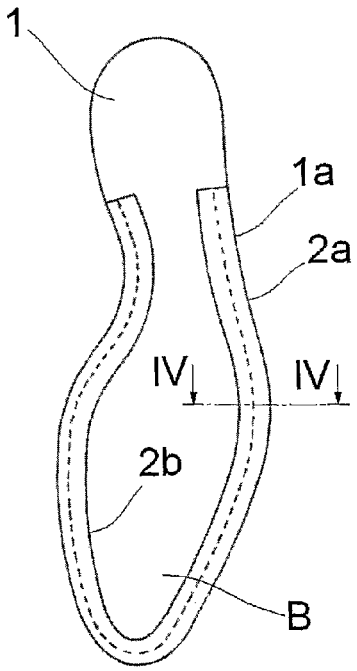
FIG. 2 shows the two basic components of the insole according to the invention after having been assembled.

In the preferred embodiment of the present process, it is provided that said outer edge 2*a*, before being stitched, is pared down so that its thickness S1 is less than the thickness S2 of the inner edge, as shown in FIG. 3.

Figure 4:
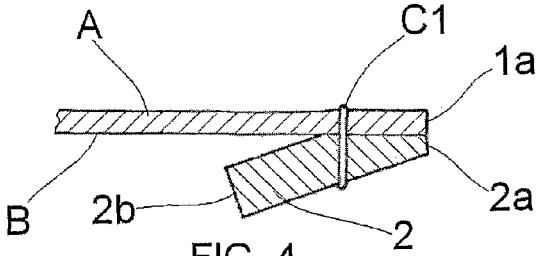
FIG. 4 is a cross-section of FIG. 2 along IV-IV.

Due to this arrangement of prior thinning of the outer edge 2*a* of the tape 2, its inner edge 2*b* tends spontaneously to detach itself from the under face B of the insole 1 while the above-mentioned stitching C1 is being sewn, as shown in FIG. 4.

Figure 5:
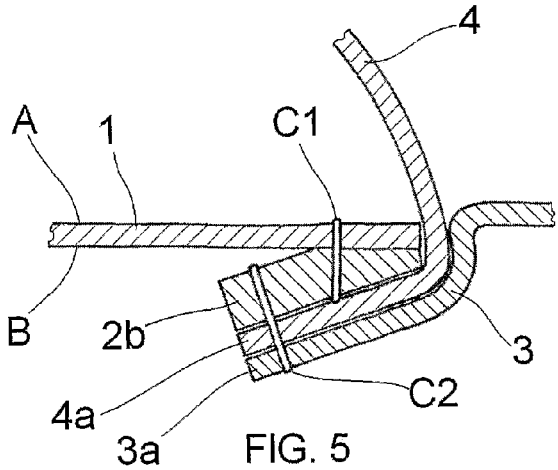
FIG. 5 is a cross-section of the insole according to the invention as stitched to the upper and to the welt.

This detachment facilitates the next machining step, which is to fix the inner edge 3*a* of the welt 3, the bottom flaps 4*a* of the upper 4 and the inner edge 2*b* of said tape 2 with a single peripheral row of stitching C2, as shown in FIG. 5; thus, the welt 3 and the upper 4 are, albeit indirectly, fixed to the insole 1 by said stitching C2 according to the provisions of the GOOD YEAR machining technique.

The fixing of the outer edge 2*a* of the tape 2 to the insole 1 may be achieved, rather than by means of said stitching C1, also by simple gluing, using water-based or neoprene glues which do not tend to stiffen once dried, as occurs with the thermoplastic adhesives commonly used thus far.

In a variant embodiment of the process according to the invention—as referred to in FIGS. 6 to 11—before fixing the tape 2 to the insole 1, it is provided that the latter is subjected to a slicing operation along a plane parallel thereto so as to be opened and divided, from the tip to the plantar arch, into a top half-insole 1*c* and a bottom half-insole 1*d*.

In this case, the tape 2 is fixed beneath the edge of the bottom half-insole 1*d*. Said splitting of the insole 1 into two half-insoles 1*c* and 1*d* is aimed at the possibility of interposing a padding layer 5 between the two half-insoles 1*c* and 1*d*, which padding layer is obviously of a size and shape as to be optimally sandwiched between the two half-insoles 1*c* and 1*d*.

Figure 9:
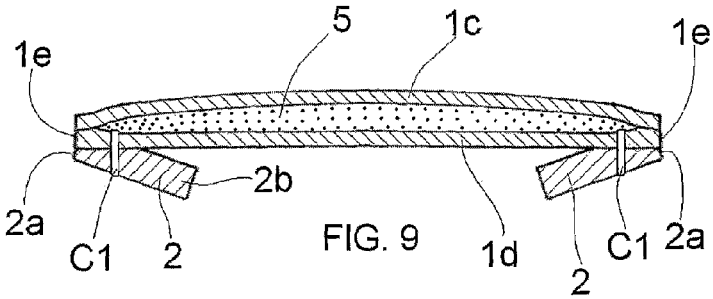
FIG. 9 is a cross-section of FIG. 7 along IX-IX.

From this perspective, the width of said padding layer 5 is preferably less than the width of the insole 1, so that the outer edges of the two half-insoles 1*c* and 1*d* can be directly glued to each other, hiding the thickness of the inner padding layer 5 from view, a thickness which thus does not increase that of the insole 1, at least around the entire edge thereof as shown in FIG. 9.

The material employed for the padding will be any soft material which can guarantee an adequate comfort for the wearer, and preferably it will be an elastically yielding material such as a foamed polymer, for example polystyrene or polyurethane, and a polyurethane gel is particularly preferred. Due to the state of aggregation of this material, it has the advantage to be particularly resistant to compression, and it also tends to take on the shape of the wearer's foot for an optimal fitting.

Figure 10:
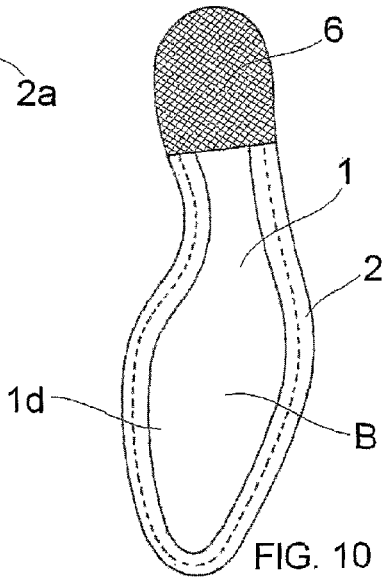
FIG. 10 shows the upper face of the insole according to the invention in the above-mentioned second structural version thereof.
Figure 11:
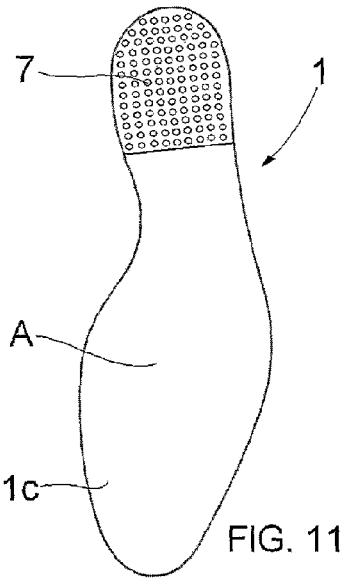
FIG. 11 shows the under face of the insole according to the invention in the above-mentioned second structural version thereof.

Once the insole 1 is thus prepared, a reinforcement heel-piece 6 made of cardboard is glued beneath the insole 1, and a corresponding heel-piece 7 made of a soft padded material is glued onto the top of the insole 1, as shown in FIGS. 10 and 11.

To sum up, the process according to the invention, in its simplest and most basic embodiment, involves the following operational steps:

- thinning the outer edge 2*a* of the tape 2;
- fixing the tape 2 beneath the insole 1, preferably by means of at least one peripheral stitching C1 running close to said outer edge 2*a* which is arranged flush with the edge 1*a* of the insole 1, while the inner edge 2*b* of the tape 2 is free to be folded and detached from the bottom face B of the insole 1;
- fixing, preferably by gluing, a reinforcement heel-piece 6 beneath the insole 1.

The insole thus prepared is now ready to be sent for fixing of the inner edge 3*a* of the welt 3 and the bottom flaps 4*a* of the upper 4 to the inner edge 2*b* of said tape 2 by means of a single peripheral row of stitching C2.

Figure 6:
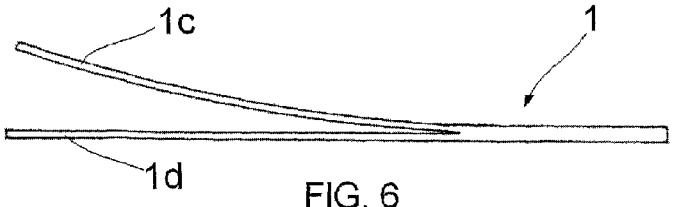
FIGS. 6, 7 and 8 show a second structural version of the insole according to the invention.
Figure 8:
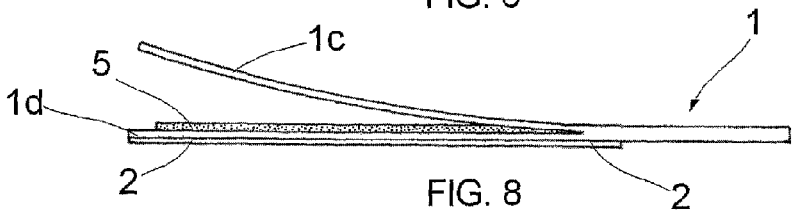
Figure 7:
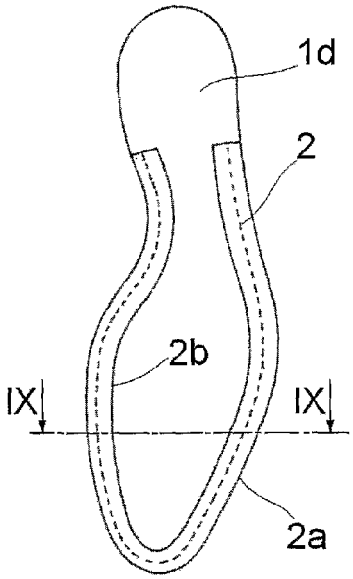

In the version in which the padding of the insole 1 is provided, the process according to the invention involves the following operational steps:

- thinning the outer edge 2*a* of the tape 2;
- cutting the insole 1 along a plane parallel thereto so as to open it up, from the tip to the plantar arch, dividing it into a top half-insole 1*c* and a bottom half-insole 1*d* as shown in FIG. 6;
- fixing the tape 2 beneath the bottom half-insole 1*d*, preferably by at least one peripheral stitching C1 running close to said outer edge 2*a* which is arranged flush with the edge 1*e* of said bottom half-insole 1*d,* while the inner edge 2*b* of said tape 2 is free to be folded and detached from the bottom half-insole 1*d,* as shown in FIG. 9;

inserting a padding layer 5 between the two half-insoles 1*c* and 1*d,* which are then laid down and glued peripherally one on top of the other to form a sandwich structure together with the intermediate layer 5, as shown in FIG. 9;

fixing, preferably by gluing, a reinforcement heel-piece 6 made of cardboard beneath the insole 1, and fixing a corresponding heel-piece 7 made of a soft material onto the top of the insole 1, as shown in FIGS. 10 and 11.

The insole thus prepared is now ready to be sent for fixing of the inner edge 3*a* of the welt 3 and the bottom flaps 4*a* of the upper 4 to the inner edge 2*b* of said tape 2 by means of a single peripheral row of stitching C2.

The invention claimed is:

1. A machining process for manufacturing an insole for footwear, a tape being provided at a bottom face of the insole around an entire periphery of the insole or with exclusion of an horseshoe arch surrounding a heel of the footwear, an outer edge of said tape being attached to and aligned with an edge of the insole so that an inner edge of said tape is free to be folded and detached from the bottom face of the insole, the process comprising the steps of:

cutting the insole along a plane parallel to the insole so as to open the insole from a tip to a plantar arch, dividing the insole into a top half-insole and a bottom half-insole;

fixing said tape beneath the bottom half-insole so that the outer edge of said tape is fixed to and aligned with an edge of the bottom half-sole, while the inner edge of the tape is free to be folded and detached from the bottom half-insole; and inserting a padding layer between the top half-insole and the bottom half-insole, said top half-insole and bottom half-insole being then laid down and glued peripherally one on top of the other, to form a sandwich structure together with the padding layer.

2. The machining process according to claim 1, wherein said outer edge of said tape, before being fixed onto the bottom face of the insole, is pared down, thus having an outer edge thickness inferior to an inner edge thickness.

3. The machining process according to claim 1, wherein the fixing of the outer edge of said tape beneath the bottom half-insole is achieved by at least one peripheral stitching extending close to the outer edge of said tape.

4. The machining process according to claim 1, wherein, after fixing the outer edge of said tape beneath the bottom half-insole, a reinforcement heel-piece made of cardboard is glued beneath the bottom half-insole, and a corresponding heel-piece made of a soft material is glued on top of the top half-insole.

5. A footwear arrangement, comprising an insole; and a tape fixed on a bottom face of the insole around an entire periphery of the insole, or with exclusion of an horse-shoe arch surrounding a heel of the footwear, an outer edge of said tape being attached to and aligned with an edge of the insole, and being foldable and detachable from the bottom face of said insole, wherein:

said insole is formed by a top half-insole and a bottom half-insole, said tape being fixed beneath said bottom half-insole, and the outer edge of the tape is fixed to and aligned with an edge of said bottom half-insole and is foldable and detachable from the bottom half-insole, the footwear arrangement further comprising a padding layer interposed between the top half-insole and the bottom half-insole.

6. The footwear arrangement according to claim 5, wherein a thickness of the outer edge of the tape is inferior to a thickness of an inner edge of the tape.

7. The footwear arrangement according to claim 5, wherein the outer edge of said tape is fixed beneath the bottom halt-insole by way of a peripheral stitching extending close to the outer edge of said tape.

8. The footwear arrangement according to claim 5, further comprising a reinforcement heel-piece made of cardboard which is glued beneath the bottom half-insole, and a corresponding heel-piece made of a soft material which is glued on top of the top half-insole.

9. The footwear arrangement according to claim 5, wherein said padding layer comprises a layer of an elastically yielding plastic material.

10. The footwear arrangement according to claim 9, wherein said padding layer comprises a layer of polyurethane gel.

11. The footwear arrangement according to claim 9, wherein the elastically yielding plastic material is a foamed polymeric material.

* * * * *